United States Patent [19]

Kaiser et al.

[11] Patent Number: 4,746,317

[45] Date of Patent: May 24, 1988

[54] ELECTRON TUBE EVACUATING MANIFOLD SYSTEM

[75] Inventors: Donald B. Kaiser, Lancaster; Robert W. Groff, Manheim, both of Pa.

[73] Assignee: RCA Corporation, Princeton, N.J.

[21] Appl. No.: 129,360

[22] Filed: Nov. 30, 1987

Related U.S. Application Data

[63] Continuation-in-part of Ser. No. 927,438, Nov. 6, 1986, abandoned.

[51] Int. Cl.[4] ..... H01J 9/385

[52] U.S. Cl. ..... 445/73; 141/65; 228/174

[58] Field of Search ..... 445/70, 73; 141/8, 82, 141/234, 239, 65; 228/174, 184

[56] References Cited

U.S. PATENT DOCUMENTS

| | | | |
|---|---|---|---|
| 1,123,833 | 1/1915 | Bartlett | 445/73 X |
| 2,417,361 | 3/1947 | Herzog | 445/70 |
| 2,538,411 | 1/1951 | Carter | 445/73 X |
| 2,871,887 | 2/1959 | Obrebski | 228/174 X |

*Primary Examiner*—Kenneth J. Ramsey

*Attorney, Agent, or Firm*—Eugene M. Whitacre; Dennis H. Irlbeck; Vincent J. Coughlin, Jr.

[57] ABSTRACT

An electron tube evacuating system includes a manifold section having an evacuation chamber. A tube mounting section has a plurality of evacuation apertures in communication with the evacuation chamber. A plurality of tube mounting members individually hermetically mount tubes to be evacuated onto the mounting section. Each mounting member has an aperture in communication with the evacuation chamber.

7 Claims, 3 Drawing Sheets

ELECTRON TUBE EVACUATING MANIFOLD SYSTEM

This is a continuation-in-part of application Ser. No. 927,438 filed Nov. 6, 1986, now abandoned.

BACKGROUND

This invention relates generally to the production of electron tubes and particularly to a manifold system for evacuating such tubes.

One of the final steps in producing electron tubes is evacuation of the tubes. To this end, every tube is provided with a narrow, hollow tubulation which is an integral part of the tube envelope. During evacuation, the tubulation is coupled to an evacuation device and the gasses within the tube are pumped out to permit operation of the tube. In the prior art, the evacuation device typically is a glass cylinder which is connected to a evacuation pump. The glass cylinder includes a number of small glass tubules which extend radially from the cylinder and which communicate with the inside of the cylinder. Typically, the small tubules have essentially the same external and internal diameters as those of the tubulations of the tubes being evacuated. The tubules and the ends of the tubulations are connected by heating them to form molten glass so that the glass hardens during cooling and the tubulations are hermetically coupled to the tubules. The tubes are then pumped down to remove the gases within the tubes. After the desired degree of evacuation is obtained, the tubulations are individually heated into a molten state. Atmospheric pressure acts on the molten glass and collapses the glass to separate the tubulations from the tubules and to hermetically seal the tubulations. After all the evacuated tubes are removed from the tubules of the evacuating cylinder, the remainders of the tubulations are removed from the tubules using glass cutters.

Evacuation cylinders of the type described are effective in evacuating tubes but suffer several disadvantages. Firstly, the evacuating systems are made of glass and thus are quite fragile. Also, the evacuation systems are made of blown glass and therefore their manufacture requires great skill. Additionally, coupling the tubulations to the tubules requires great skill, is a time consuming task and the separation of the tubulation remainders from the tubules requires substantial skill to avoid damage to the evacuating system. Furthermore, the tubulations and tubules are rigidly coupled and therefore a slight jar can break a tubulation and ruin all tubes which are coupled to the evacuating cylinder. For these reasons there is a need for a rugged, electron tube evacuating manifold system which is easy to manufacture and to use and which does not require glass blowing and glass handling skill in the manufacture and use thereof. The present invention fulfills these needs.

SUMMARY

A manifold system for simultaneously evacuating a plurality of electron tubes each having an exhaust tubulation. The manifold system includes at least one manifold section having an evacuation chamber extending the length of the manifold section. An electron tube mounting section extends along the manifold section. The mounting section includes a plurality of evacuation apertures communicating with the evacuation chamber by means of a plurality of communicating apertures. The mounting section also includes protecting means circumscribing each of the communicating apertures for protecting the exhaust tubulations for damage. A plurality of electron tube mounting members individually hermetically mount electron tubes to the mounting section. The mounting members each has means to sealingly receive the tubulations of tubes to be evacuated and communicate the tubulations through the communicating apertures to the evacuation chamber. The system also includes means for evacuating gases from the tubes and from the evacuation chamber.

DETAILED DESCRIPTION

Figure 1:
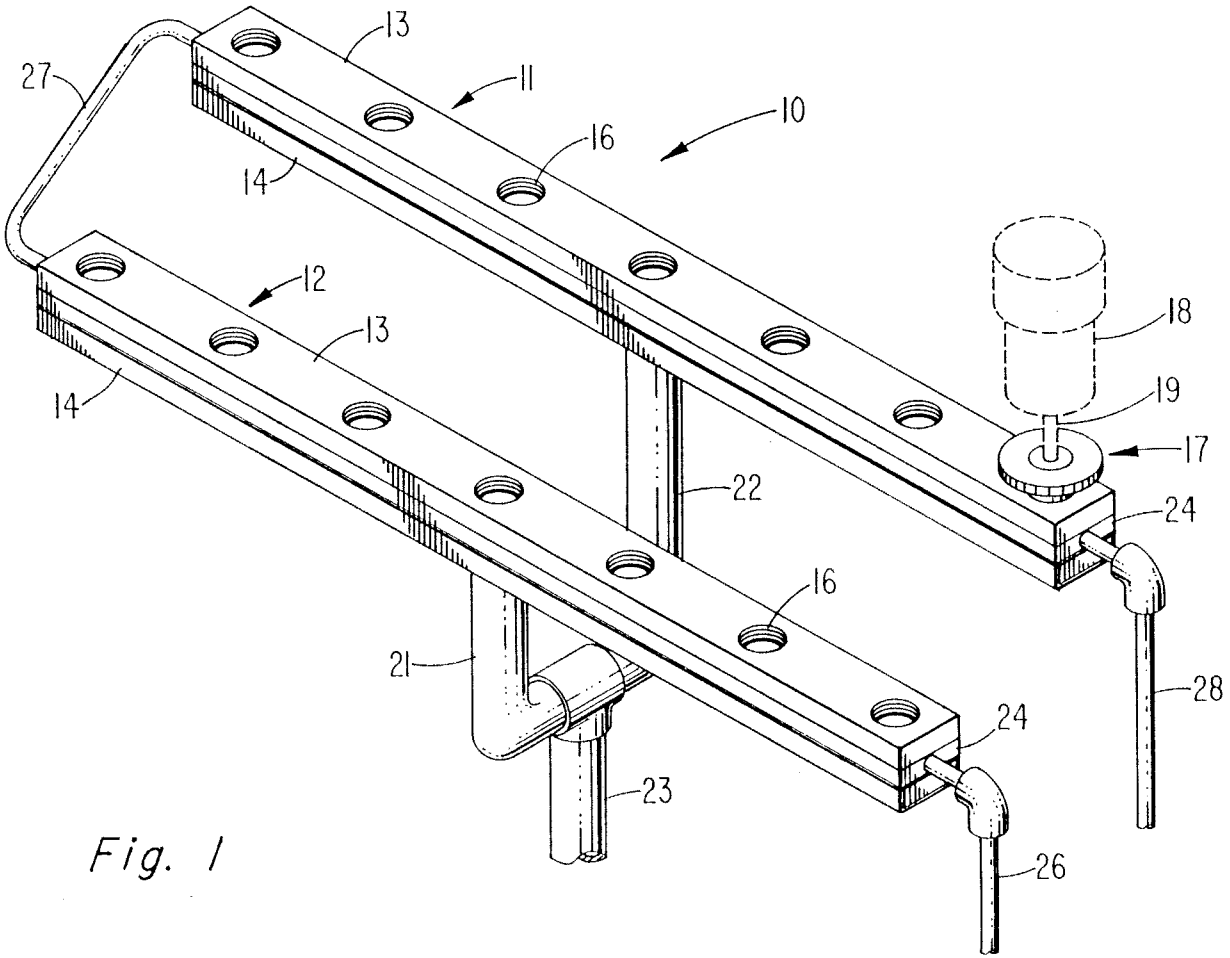
FIG. 1 is an isometric view of a preferred embodiment.
Figure 2:
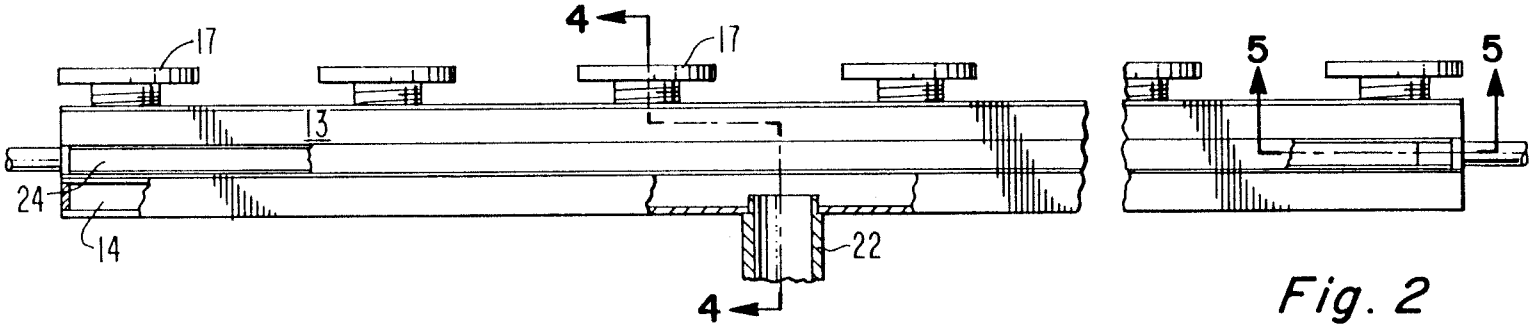
FIG. 2 is a side view, partially broken away and partially in cross section, of one portion of the preferred embodiment in FIG. 1.

In FIG. 1, an evacuating manifold system 10 includes two manifold sections 11 and 12 arranged in a substantially parallel relationship. Each of the manifold sections 11 and 12 includes an electron tube mounting section 13 and an evacuation chamber 14. Each of the tube mounting sections 13 include a plurality of evacuation apertures 16 spaced along the length of the sections. The evacuation apertures 16 are dimensioned and threaded to receive electron tube mounting members 17 which are used to mount electron tubes 18, shown in phantom, by way of exhaust tubulations 19 which are integral with the tubes 18. Each of the members 17 includes a threaded knob 33 with a longitudinally-extending through-hole 29, a resilient annular member 37 and a compression washer 38. The evacuation chambers 14 are coupled to an evacuation pump, not shown, of a type known to those skilled in the art, by metal tubing sections 21, 22 and 23. The tubing sections 21 and 22 extending above the bottom of the evacuation chamber 14 to prevent tube-source debris, e.g. glass particles from entering the pump. Cooling sections 24 are arranged in each of the manifold sections 11 and 12. Cooling fluid enters the cooling sections 24 of the manifold section 12 from an inlet 26 and is communicated to the tube manifold section 11 by a tube 27 and exits through a tube 28.

Figure 3:
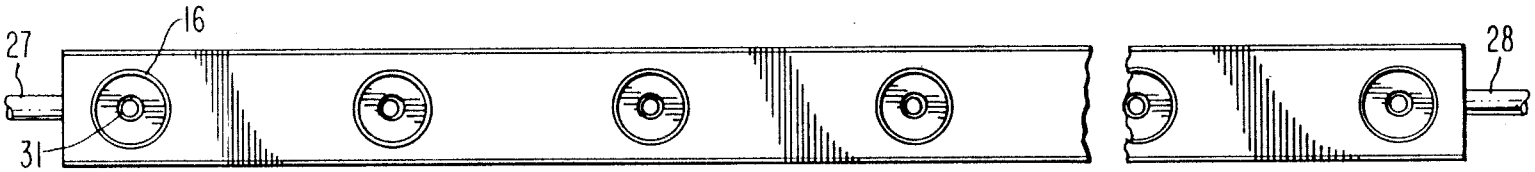
FIG. 3 is a top view of the FIG. 2.
Figure 4:
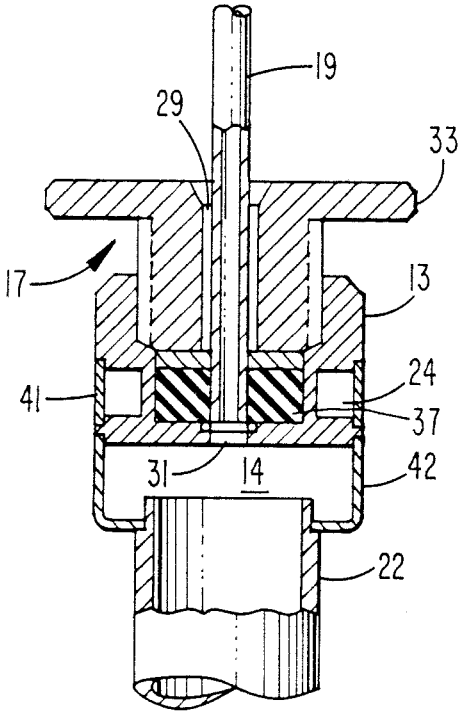
FIG. 4 is a cross section of the electron tube mounting member taken along line 4—4 of FIG. 2.
Figure 6:
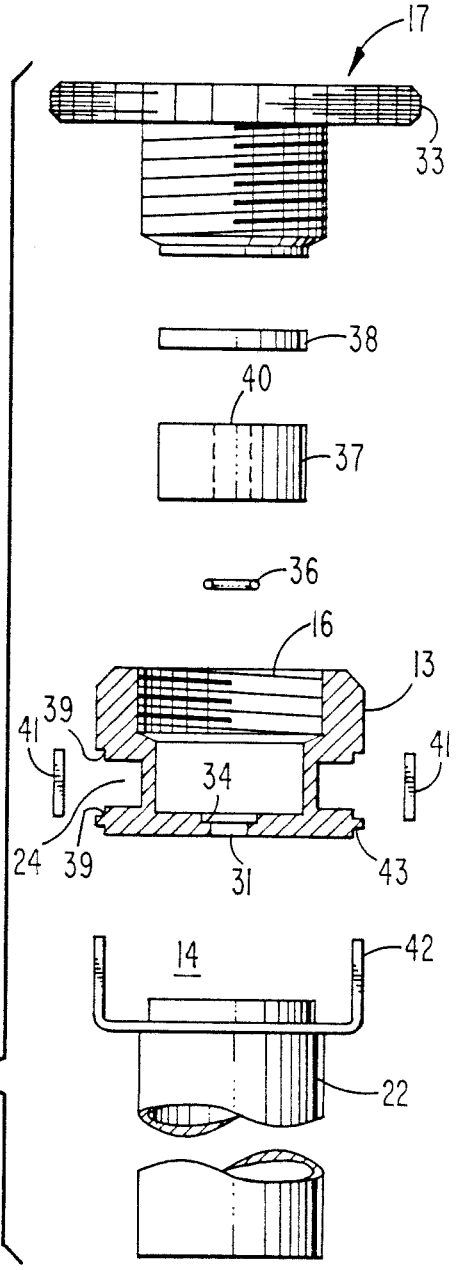
FIG. 6 is an exploded view of the electron tube mounting member of FIG. 4.

In FIGS. 3, 4 and 6, the apertures 16 do not extend completely through the mounting sections 13 and include communicating apertures 31 which communicate with the evacuation chamber 14. The longitudinally-extending through-holes 29 provide a clearance between the tubulations 19 and the threaded knob 33 so that the tubulations are free to slightly move in the through-holes and are less likely to break if slightly bumped or jarred.

Figure 5:
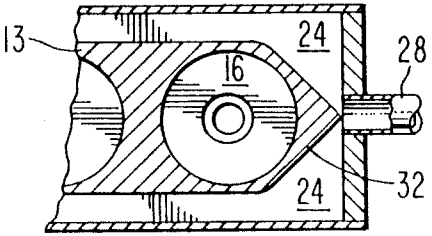
FIG. 5 is a cross section along line 5—5 of FIG. 2.

In FIG. 5, the mounting section 13 has an apex 32, on each end, and is substantially centered with respect to the center of the fluid inlet 28. Accordingly, fluid entering the cooling chambers 24 from the inlet 28 is split substantially equally to the two cooling chambers.

In FIGS. 4 and 6 the threaded knobs 33 of the electron tube mounting member 17 thread into the evacuation apertures 16. Each of the communicating apertures 31, formed in the mounting section 13, is circumscribed by an instep portion 34 to receive and support an O-ring 36. The O-ring 36 has internal and external diameters selected to support and protect the end of the tubulation of each of the electron tubes so that the tubulations will not chip, crack, or be damaged by the mounting section when in communication with the evacuation chamber 14 through the communicating apertures 31. The annular resilient member 37 is configured and dimensioned to fit snuggly into the aperture 16 and to include a centered aperture 40 through which the tubulation 19 passes. The compression washer 38 is dimensioned similarly to the resilient member 37 and also includes a centered aperture, not shown, to pass the tubulation 19. As the knob 33 is threaded into the threads of the aperture 16, the compression washer 38 acts against the resilient member 37 to seal the member 37 against the sides of the aperture 16 and also around the tubulation 19. Accordingly, the tubulation is sealed and the tube 18 can be evacuated while the through-hole 29 permits some movement of the tube 18.

The outside of the mounting section 13 is milled to form the cooling sections 24 and includes slots 39. Rigid side members 41 fit into the slots 39 to form the cooling chambers through which the cooling fluid passes. The evacuation chamber 14 is formed of a channel-shaped member 42 which is dimensioned to fit into milled corner 43 of the mounting section 13. The channel member 42 and the side members 41 are hermetically fixed to the mounting section 13 by welding for example.

In operation, the inventive evacuating manifold system 10 is very simple to use in that the tubulation 19 of a tube 18 is passed through the hole 29 in the threaded knob 33 for evacuation. The tubulation is then inserted through the compression washer 38, the resilient member 37 and against the O-ring 36, resting in the instep portion 34. The threaded knob 33 is threaded into the evacuation aperture 16 causing the resilient member 37 to seal the tubulation permitting evacuation of the tube. Each of the manifold sections 11 and 12 is provided with a plurality of evacuation apertures 16. When the number of tubes to be evacuated is less than the number of evacuation apertures 16 in the manifolds, solid members are inserted into the unused apertures. Different sizes of tubes can have different tubulation diameters. This poses no problem because the through-holes and the centered apertures in the threaded knobs 33, the compression washers 38 and the resilient members 37 are dimensioned to fit a particular tube size. Accordingly, these elements are changed when the tube size changes and the manifold system can be used for all tubulation sizes.

We claim:

1. A manifold system for simultaneously evacuating a plurality of electron tubes each having an exhaust tubulation comprising:

At least one manifold section having an evacuation chamber extending the length of said manifold section;

an electron tube mounting section extending along said manifold section, said mounting section having a plurality of evacuation apertures communicating with said evacuation chamber by means of a plurality of communicating apertures, said mounting section having protecting means circumscribing said communicating apertures to protect said exhaust tubulations from damage;

a plurality of electron tube mounting members for individually hermetically mounting said electron tubes to said mounting section, said mounting members each having means to sealingly receive the tubulations of tubes to be evacuated and to communicate said tubulations through said communicating apertures with said evacuation chamber; and means for evacuating gases from said tubes and from said evacuation chamber, said means extending into said evacuation chamber.

2. The manifold system of claim 1 further including a cooling section extending along said manifold section, and also further including means for pumping cooling fluid through said cooling section.

3. The manifold system of claim 2 wherein said tube mounting members are threaded into said evacuation apertures, and wherein said means to sealingly receive the tubulations of tubes to be evacuated include resilient sealing members having apertures for receiving said tubulations, and means for compressing said resilient sealing members to hermetically seal said tubulations in said mounting members.

4. The manifold system of claim 3 wherein said manifold section and said mounting section are elongated and substantially parallel.

5. The manifold system of claim 4 wherein there are a plurality of said manifold sections arranged in a substantially parallel relationship.

6. The manifold system of claim 1 wherein said protecting means includes an O-ring disposed within an instep circumscribing each of said communicating apertures.

7. The manifold system of claim 1 wherein said means for evacuating gases from said tubes and from said evacuation chamber include tubing sections offset relative to said communicating apertures and extending above the bottom of the evacuation chamber to protect an evacuation pump from tube-source debris.

* * * * *